US006115905A

United States Patent [19]

Ueta

[11] Patent Number: 6,115,905

[45] **Date of Patent: *Sep. 12, 2000**

[54] METHOD FOR CONNECTING LAMINATED METAL PLATES AND PRESS MOLD

[75] Inventor: Kosaku Ueta, Kumagaya, Japan

[73] Assignee: Japan Metal Gasket Co., Ltd., Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/043,262

[22] PCT Filed: Nov. 20, 1996

[86] PCT No.: PCT/JP96/03401

§ 371 Date: Mar. 12, 1998

§ 102(e) Date: Mar. 12, 1998

[87] PCT Pub. No.: WO97/18911

PCT Pub. Date: May 29, 1997

[30] Foreign Application Priority Data

Nov. 20, 1995 [JP] Japan ..... 7-301304

[51] Int. Cl.[7] ..... B23P 11/00

[52] U.S. Cl. ..... 29/432.2; 29/243.5; 29/509; 277/595

[58] Field of Search ..... 29/432.2, 521, 29/522.1, 432, 432.1, 509, 243.5, 243.53, 283.5, 798; 277/590, 595, 598

[56] References Cited

U.S. PATENT DOCUMENTS

| | | | |
|---|---|---|---|
| 2,924,312 | 2/1960 | Williams . | |
| 3,726,000 | 4/1973 | Hafner | 29/21.1 |
| 5,408,735 | 4/1995 | Schlieicher | 29/432.2 |
| 5,621,961 | 4/1997 | Schleicher | 29/509 |

FOREIGN PATENT DOCUMENTS

| | | |
|---|---|---|
| 0 215 385 | 3/1987 | European Pat. Off. . |
| 2 337 599 | 1/1976 | France . |
| 62-72441 | 3/1981 | Japan . |
| 56-59539 | 5/1981 | Japan . |
| 58-188522 | 11/1983 | Japan . |
| 62-15123 | 1/1987 | Japan . |
| 62-77130 | 9/1987 | Japan . |

*Primary Examiner*—S. Thomas Hughes
*Assistant Examiner*—John C. Hong
*Attorney, Agent, or Firm*—Young & Basile, P.C.

[57] ABSTRACT

In a method for connecting laminated metal plates comprising the steps of forming a plurality of cutting lines independent from each other in a laminated metal plate, and forming a projecting portion by making a metal plate between the cutting line protrude in a laminating direction by a step that is higher than the thickness of the laminated plate, the following solutions are adopted with a view to preventing securely the dislocation of the metal plates in the laminating direction and also preventing securely the deviation of the metal plate in every direction in the laminated plate surface by the two cutting lines. After forming on the laminated metal plate a projecting portion including the central portion thereof through engagement of male and female molds, the laminated metal plate is pressurized between pressing convex portion and an engagement surface so as to pressingly expand an end to be cut in a gap between the male and female molds, whereby this end to be cut is caused to overlap an end to be cut of the central portion of the projecting portion in the laminating direction. In addition, the cutting lines are formed so as to radially extend from a central point of the central portion of the projecting portion.

8 Claims, 12 Drawing Sheets

METHOD FOR CONNECTING LAMINATED METAL PLATES AND PRESS MOLD

The present invention relates to method for connecting laminated metal plates such as a metal gasket or the like formed by laminating a plurality of metal plates including a base plate and a sub-plate, and to a press mold used for the same.

BACKGROUND ART

Conventionally, in a metal gasket formed by superposing a plurality of metal plates, as shown in FIG. 19, the plurality of metal plates are connected in a laminating direction by forming a connecting portion 41 of a tongue shape at an outer peripheral edge outside a joining surface between a cylinder block and a cylinder head, and by forming an eyelet hole 5 by forming a through hole in the connecting portion 41, inserting a metal fitting for locking through the hole, and by collapsing the metal fitting, and alternatively, the metal plates are welded at this connecting portion 41.

However, the method by means of the eyelet hole requires labour hours for connecting work, and the method by the welding requires facility cost although the labour hours are reduced. Thus, a method for making the connecting work easy is required.

In this respect, Japanese Patent Laid Open Publication Hei No. 6-281011 discloses a method for connecting a metal gasket by a press work. In this method, as shown in FIGS. 20 to 22, a plurality of cutting lines 30*a* independent of one another are formed in laminated metal plates, and at the same time, a projecting portion 30*b* is formed by protruding a metal plate portion between the cutting lines 30*a* by a height larger than a thickness of the laminated metal plates in a laminating direction, and furthermore, a burr is formed at the cut end portion by making a break line by extending a portion 30*c* of the cutting line 30*a*.

In this method, the displacement or slippage of the laminated metal plates in the plate plane in a direction intersecting an extending direction of the cutting line is prevented by collision, at opposite ends of the cutting line, between a cut end face of the laminated metal plate portion not protruded and an end face of the protruded portion, and the slippage or displacement of the laminated metal plates in the laminating direction is prevented by spring back of the burr.

However, in the connecting structure described in the above-mentioned Japanese Patent Laid Open Publication Hei No. 6-281011 as shown in FIGS. 20 to 22, it is described that when viewed in the laminating direction, the tip end portions of the burrs overlap with each other and the overlapped portions serve as the slippage or displacement preventing means, however, in practice, the slippage or displacement preventing effect was not sufficient. Furthermore, in order to prevent the displacement in every direction in the plate plane of the laminated metal plates, it is necessary to form three or more cutting lines as shown in FIG. 20 or 21, and a problem is involved in which a mold used to form such a connecting structure has a complicated structure, and it is easily broken and the cost is high.

The present invention was made in view of the problems in the prior art as mentioned above, and it is a subject to provide a method which prevents the slippage or displacement of the metal plates in the laminating direction, and which prevents the displacement of the laminated metal plates in every direction in the plate plane without making a mold shape complicated, and still, can be done by press forming of one time, and to provide a press mold used for the method.

DISCLOSURE OF THE INVENTION

In order to solve the above mentioned subject, the invention provides a method for connecting laminated metal plates, in the method for connecting laminated metal plates with each other by forming two cutting lines mutually independent of each other in the laminated metal plates, and by forming a projecting portion by protruding a metal plate portion between the cutting lines by a step having a height larger than a laminated metal thickness in a laminating direction. It is characterized in that after forming the protecting portion, a cut end portion of the metal plates from which the projecting portion is cut out is pressed and expanded.

According to this method, since the cut end portion at which the metal plates are expanded is made to overlap with the cut end portion of the projecting portion in the laminating direction, the slippage or displacement of the metal plates in the laminating direction is surely prevented.

In the invention, it is characterized in that the projecting portion is constituted by a center portion protruding highest from the surface of the metal plates which are not protruded, and a pair of slant surface portions which are slanted from the center portion towards the surface of the metal plates, and the total of four slant surface forming portions of each cutting line are formed so that two slant surface forming portions which are adjacent to each other in a circumferential direction are directed respectively to two different directions in the plane of the laminated metal plates.

According to this method the displacement among the metal plates in every direction in the plane of the laminated metal plates is prevented by the two cutting lines. By virtue of this, since the length of the cutting lines can be increased with respect to the size of the projecting portion, the displacement among the metal plates in the plane of the laminated metal plates is surely prevented. Furthermore, when the cutting lines are made long, since the center portion of the projecting portion can be made large, it is possible to increase the cut end portion of the expanded metal plates so as to ensure sufficient overlap with the cut end portion of the projecting portion. Thus, the slippage or displacement of the metal plates in the laminating direction can be securely prevented.

The invention is further characterized in that the slant surface forming portions respectively extend along lines extending radially from the center portion.

According to this method, since it is possible to widen a rising width of the projecting portion while increasing the length of the cutting lines, the displacement among the metal plates in the plane of the laminated metal plates can be surely prevented while maintaining the strength of the rising portion of the projecting portion.

In the invention, a method for connecting laminated metal plates is provided, in which the method for connecting laminated metal plates with each other by forming two cutting lines independent of each other in the laminated metal plates, and at the same time, by forming a projecting portion by protruding a metal plate portion between the cutting lines by a step having a height larger than a thickness of the laminated metal plates in a laminating direction, is characterized in that the projecting portion is constituted by a center portion protruding highest from the surface of the metal plates from which the projecting portion is cut out, and a pair of slant surface portions which are slanted from the center portion towards the surface of the metal plates, and the total of four slant surface forming portions of each of the cutting lines are formed so that two slant surface forming portions adjacent to each other in a circumferential direction are directed to two different directions in the plane of the laminated metal plates.

The invention is characterized in that the slant surface forming portions respectively extend along lines extending radially from the center portion.

The invention provides a method for connecting laminated metal plates, in which the method for connecting laminated metal plates with each other by forming two cutting lines independent of each other in the laminated metal plates, and at the same time, by forming a projecting portion by protruding a metal plate portion between the cutting lines by a step having a height larger than a thickness of the laminated metal plates in a laminating direction, is characterized in that the projecting portion is pressed and deformed so that, in sections of the projecting portion in a direction intersecting the two cutting lines, opposite cutting line sides respectively approach the surfaces of the metal plates more than a center side.

According to the connecting structure obtained by this method, against the displacement of the metal plates in the laminating direction, the cutting line side end portions of the projecting portion are respectively caught by the end portions of the metal plates so that the projecting portion is deformed in a direction to widen its width (the size between the two cutting lines). And still since the deformation becomes larger as the metal plates tend to displacement further, the sufficient overlap between the cutting end portions of the projecting portion and the cutting end portions or the metal plates in the laminating direction is obtained, and the slip out of the metal plates in the laminating direction is surely prevented.

The invention provides a press mold used for connecting laminated metal plates with each other by forming two cutting lines independent of each other in the laminated metal plates, and at the same time, by forming a projecting portion by protruding a metal plate portion between the cutting lines by a step having a height larger than a thickness or the laminated metal plates in a laminating direction, the press mold is characterized in that an engagement convex portion formed on an engagement surface of a male mold with a female mold has a center projecting surface protruding with a larger size than a thickness of the metal plates, and a pair of slant surfaces slanted from the projecting surface towards the engagement surface. The engagement convex portion further includes two cutting lines formed in an edge shape formed by widthwise visible outlines or the pair of slant surfaces and visible outlines of the projecting surface which connect the widthwise visible outlines, and an interval between the cutting lines at the projecting surface of the male mold is made smaller than an interval of corresponding cutting lines of the female mold by a predetermined size (the size which allows to form an interval sufficient to cut by tension not by shearing, at the time of engagement of the male and female molds), and on at least one engagement surface of the male and female molds, there is formed with pressing convex portions at positions along or outside both the cutting lines located at an engagement concave portion or the female mold which receives the projecting surface at the time of engagement of both molds.

According to this press mold, at the time of engagement or the engagement convex portion or the male mold with the engagement concave portion of the female mold with the laminated metal plates sandwiched therebetween, the laminated metal plates are sheared by the cutting lines of the slant surfaces, but with the cutting lines of the projecting surface portion, the laminated metal plates are extended in the laminating direction and cut by tension. As a result, the metal plate portion between the two cutting lines is protruded towards the laminating direction with a step having a height larger than the thickness of the laminated metal plates, so that this projecting portion projects to its highest position at its center portion from the surface of the metal plates from which the projecting portion is cut out, and this projecting portion has slant surface portions slanted towards the surface of the metal plates.

When the engagement of the male and female molds further progresses, after the above-mentioned cutting, the laminated metal plates are pressed between the pressing convex portion and its opposing engagement surface (or mutually opposing convex portions with each other), and since the cut end portion of the rest of the laminated metal plates from which the center portion has been cut out is pressed and expanded in the above-mentioned gap, a sufficient overlap between the cut end portion of the projecting portion and the cut end of the rest of the laminated metal plates can be obtained. As a result, the displacement of the metal plates in the laminating direction is securely prevented.

Accordingly, if this mold is used, by a press forming of one time, a connecting structure constituted by two cutting lines independent of each other, and a projecting portion formed by protruding a metal plate portion between the cutting lines by a step having a height larger than a thickness of the laminated metal plates, can be formed simply in a press work of one time resulting in a condition wherein the cut end portion of the laminated metal plates is collapsed and expanded. As a result, the connecting structure in which the metal plates are difficult to displacement in the laminating direction can be formed simply by a press work of one time.

The invention is characterized in that the slant surfaces are slanted from the projecting surface towards the engagement surface with their skirt portions outwardly tapered.

According to this press mold, since the projection lines of the widthwise visual lines of the slant surface onto the engagement surface form lines which taper radially from the projecting surface, the connecting method of the laminated metal plates can be easily performed by press forming of one time.

Here the displacement of the metal plates in the laminating direction can be surely prevented. In particular, in addition to this, the displacement among the metal plates in every direction in the plane of the laminated metal plates can be surely prevented by the two cutting lines. Furthermore, since the strength of the rising portion of the projecting portion is maintained, the sure effect can be expected in the case where the laminated thickness is thick in particular.

According to the method, the displacement among the metal plates in every direction in the plane of the laminated metal plates can be surely prevented by the two cutting lines. Furthermore, since the strength of the rising portion of the projecting portion is maintained, the sure effect can be expected in the case where the laminated thickness is thick in particular.

According to the press mold, since it is possible to form the connecting structure in which the metal plates are difficult to slip out in the laminating direction simply by a press work of one time, the time required for the connecting work of the laminated metal plates can be reduced. In particular, it is possible to simply form by a press work of one time the ideal connecting structure in which the displacement or the metal plates, in the laminating direction is surely prevented, and the displacement among the metal plates in every direction is surely prevented by the two cutting lines, and the strength at the rising portion of the projecting portion is maintained.

BEST MODE FOR CARRYING OUT THE INVENTION

Hereinafter, one mode for carrying out the present invention will be described with reference to the drawings.

Figure 1:
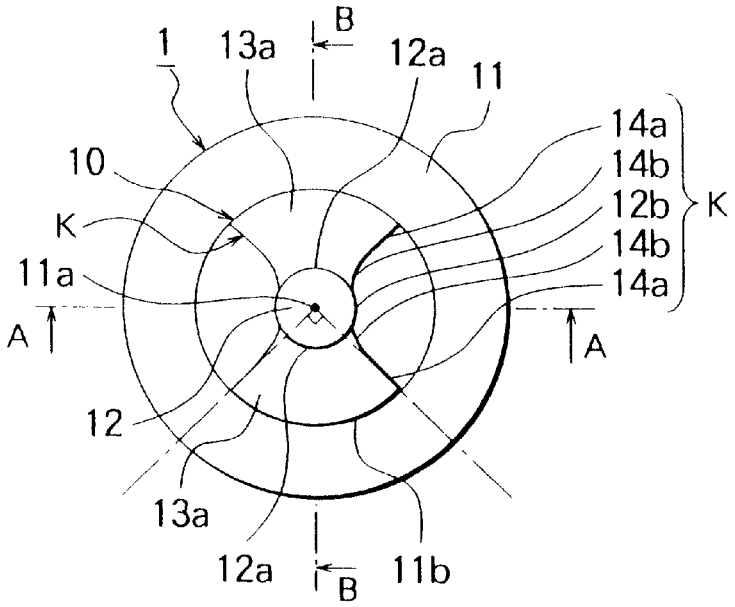
FIG. 1 is a plan view showing an engagement surface side of the male mold with the female mold in the above-mentioned mode for carrying out the invention.
Figure 2:
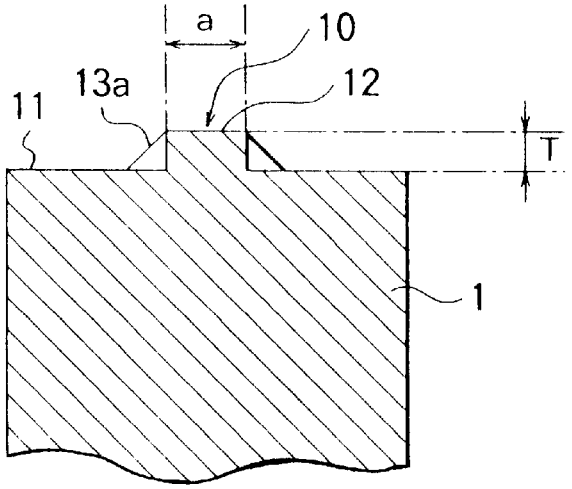
FIG. 2 is a sectional view taken along the line A—A in FIG. 1.
Figure 3:
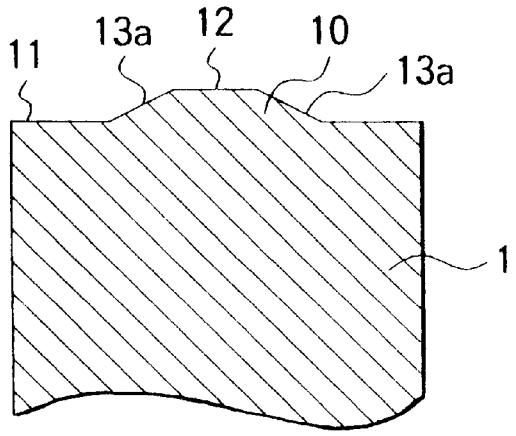
FIG. 3 is a sectional view taken along the line B—B in FIG. 1.

First, with reference to FIGS. 1 to 6, one mode for carrying out a press mold of the present invention will be described. In which, FIGS. 1 to 3 show a male mold, and FIG. 1 is a plan view showing an engagement side with a female mold, FIG. 2 is its sectional view taken along the line A—A, and FIG. 3 is a sectional view taken along the line B—B.

As shown in these figures, in the male mold 1, an engagement convex portion 10 having a longitudinal section of a substantially trapezoid configuration is formed on a center portion or an engagement surface 11 which is an end face of a mold column, and this engagement convex portion 10 has a small circular projecting surface 12 protruding from the center of the engagement surface 11 by a height dimension of T, and has a pair of slant surfaces 13*a* slanted from the projecting surface 12 towards the engagement surface 11. Here, the height dimension of T is larger than a thickness of the laminated metal plates to be connected. Further, each of the slant surfaces 13*a* is slanted from a small circular arc 12*a* or the projecting surface 12 towards a large circular arc 11*b* on the engagement surface 11 while outwardly tapering the skirt portion thereof, and the pair of slant surfaces 13*a* are slanted to the sides 180 degrees apart from each other.

Furthermore, the visible outlines of the slant surface 13*a*, in the plan view (FIG. 1), are constituted by radial portions 14*a* extending radially from the center 11*a* of a circle forming the engagement surface 11 at a 90 degrees interval therebetween, and circular arc portions 14*b* respectively connecting the radial portions 14*a* with the ends or a small circular arc 12*a* of the projecting surface 12. A cutting line is formed along a projecting line K consisting of the radial portions 14*a*, the circular arc portions 14*b*, and a circular arc 12*b* which is not continuous with the slant surfaces 13*a* of the projecting surface 12 (the line K is formed by connecting in the order the radial portion 14*a*, circular arc portion 14*b*, circular arc 12*b*, circular arc portion 14*b*, and radial portion 14*a*).

Figure 4:
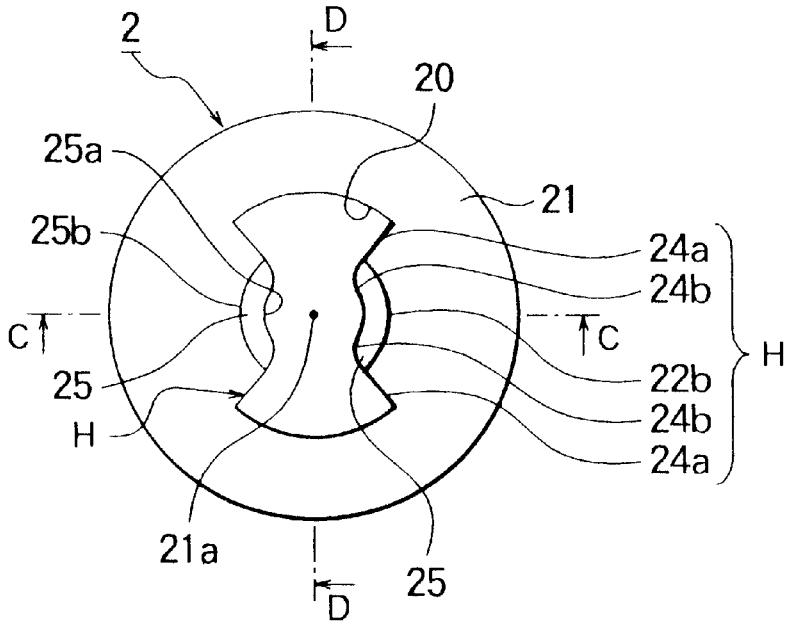
FIG. 4 is a plan view showing an engagement surface side of the female mold with the male mold in the above-mentioned mode for carrying out the invention.
Figure 5:
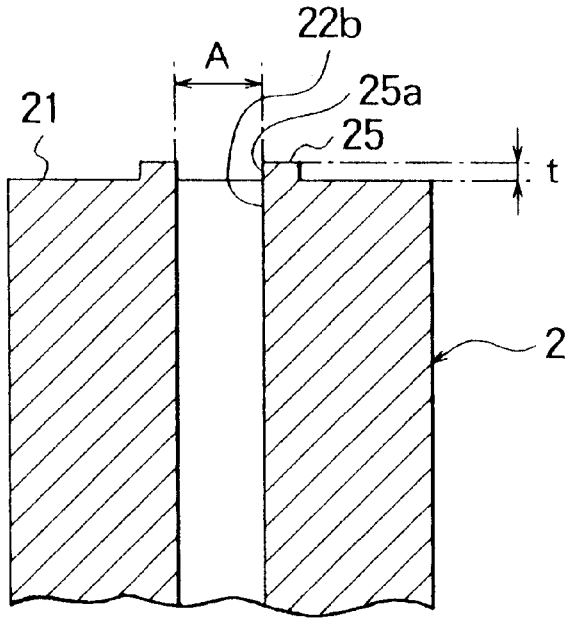
FIG. 5 is a sectional view taken along the line C—C in FIG. 4.
Figure 6:
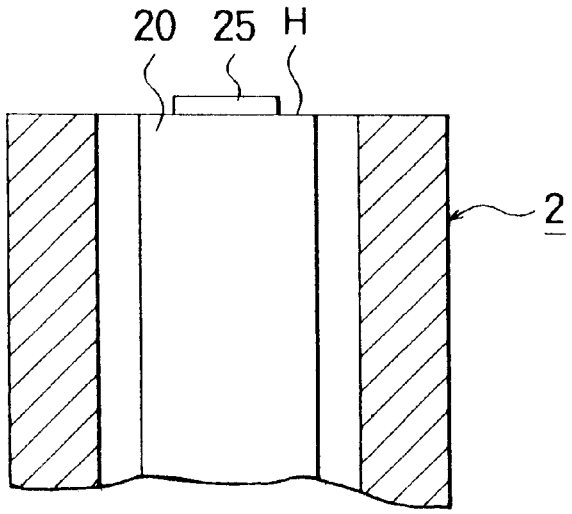
FIG. 6 is a sectional view taken along the line D—D in FIG. 4.

FIGS. 4 to 6 show the female mold, in which FIG. 4 is a plan view showing an engagement surface side with the male mold, FIG. 5 is its sectional view taken along the line C—C, and FIG. 6 is its sectional view taken along the line D—D.

As shown in these figures, the female mold 2 has an engagement surface 21 formed by an end face of a mold column, and this engagement surface 21 is formed with an engagement concave portion 20 for receiving the engagement convex portion 10 of the male mold 1 described earlier. This engagement concave portion 20 has a sectional shape perpendicular to an axial direction of the column identical to a plan shape of the engagement convex portion 10, and it is formed as a hole penetrating in the axial direction and having no bottom surface. A cutting line is formed along a line H (a radial portion 24*a*, circular arc portion 24*b*, circular arc 22*b*, circular arc portion 24*b*, and radial portion 24*a* are connected in this order) on the engagement surface 21 corresponding to the projecting line K of the male mold 1.

The radial portion 24*a* of the line H is formed so that no gap is caused in particular between this portion and the radial portion 14*a* of the projecting line K at the time of engagement with the male mold 1 (a normal gap required for shearing is formed). However, for the circular arc portion 24*b* and circular arc 22*b*, a diameter A (shown in FIG. 5) of a circle containing the circular arc 22*b* is made larger than a diameter a (shown in FIG. 2) of a circle containing the circular arc 12*b* of the male mold 1 by a predetermined dimension so that a predetermined gap (the gap required for tension cutting not for shearing) is formed from the circular arc portion 14*b* and circular arc 12*b* of the projecting line K.

Furthermore, the female mold 2 has pressing convex portions 25 whose projecting surfaces are in parallel with the engagement surface 21, and an inner peripheral line 25*a* of the pressing convex portion 25, in the plan view, is formed by the circular arc portion 24*b* and circular arc 22*b* or the engagement concave portion 20, and an outer peripheral line 25*b* of the pressing convex portion 25 is formed by a circular arc having the same center 21*a* as that of the engagement surface 21 and positioned at the outside of the circular arc 22*b* by a small distance. Specifically, the pressing convex portions 25 are formed along both the cutting lines of the engagement concave portion 20 or the female mold 2. Also, a projecting height t of the pressing convex portions 25 from the engagement surface 21 is set to be sufficiently smaller than the height T of the engagement convex portion 10 of the male mold 1; and these heights t and T, and a thickness L of the laminated metal plates are set to meet the relation of the following formula (1).

$$(T-t)>L \quad (1)$$

Figure 7:
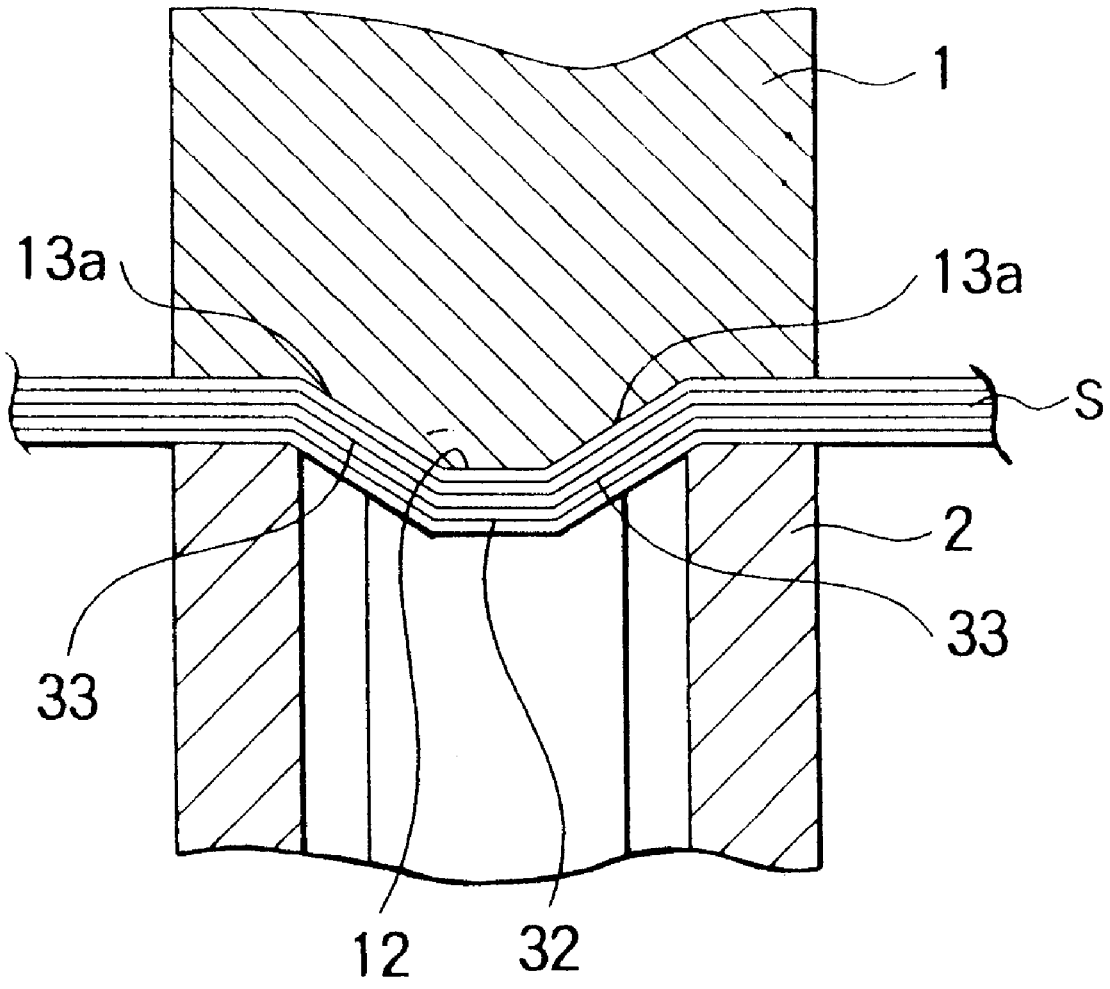
FIG. 7 is a sectional view showing an engagement condition of the male and female molds along the B—B line section in FIG. 1.
Figure 8B:
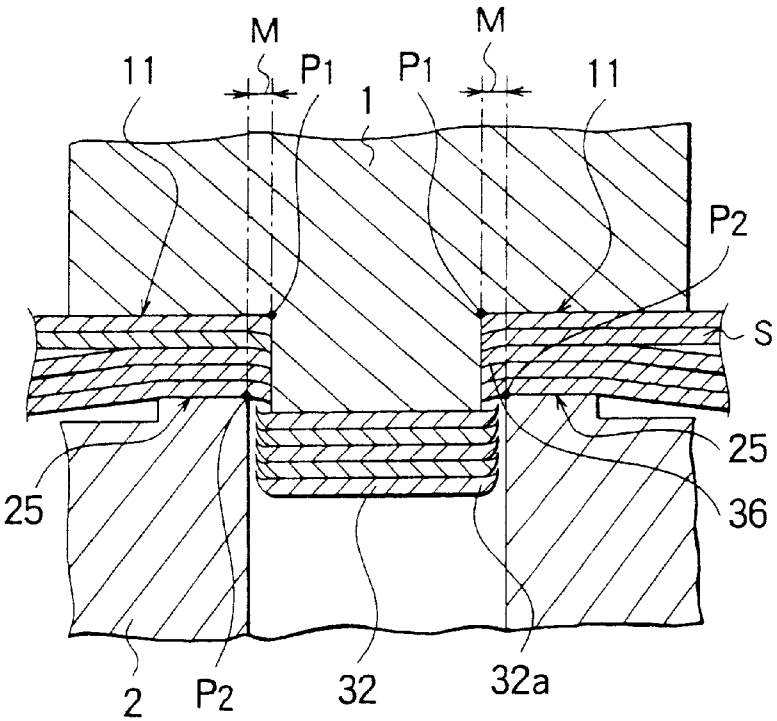
FIGS. 8*a* and 8*b* are sectional views showing an engagement condition of the male and female molds along the A—A line section in FIG. 1, in which 8(*a*) shows a condition just before the insertion of the male mold into the female mold, and 8(*b*) shows an inserted condition.
Figure 8A:
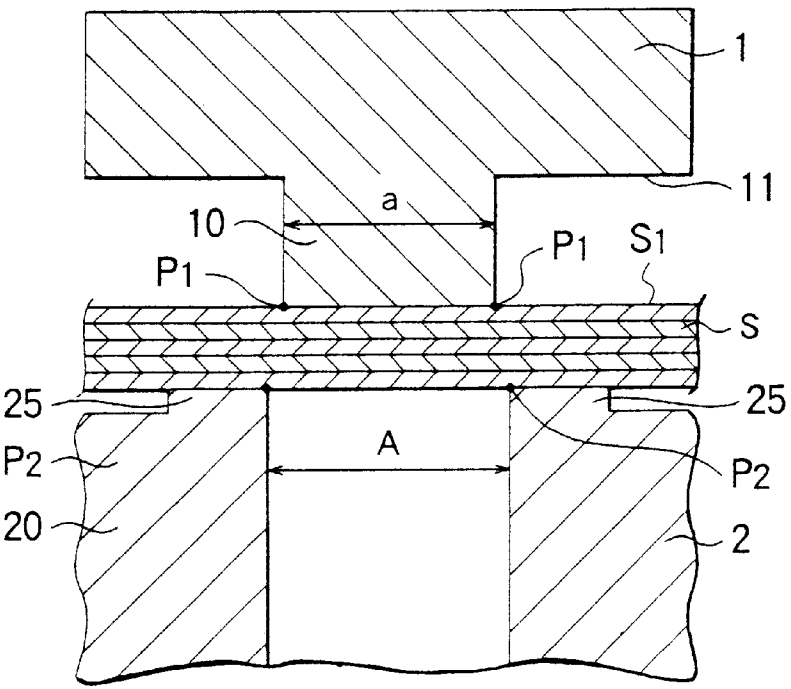

When the laminated metal plates S are sandwiched between such an engagement surface 11 of the male mold 1 and the engagement surface 21 of the female mold 2, and the male mold 1 is inserted into the female mold 2 as shown in FIGS. 7 and 8*a* and 8*b*, a connecting structure 3 is formed, as shown in FIGS. 9*a*, 9*b* to 11, which is constituted by two cutting lines 3*a*, 3*a* independent of each other, and a projecting portion 3*b* formed by protruding a metal plate portion between these cutting lines 3*a*, 3*a* in the laminating direction by a step having a height larger than the thickness of the laminated metal plates. Furthermore, the projecting portion 3*b* is constituted by a center portion 32 which protrudes to its highest position from a metal plate surface V of the metal plates from which the projecting portion is cut out, and a pair of slant surface portions 33 which are slanted towards the surface V while forming outwardly tapering skirt portions. Here, FIGS. 9*a*, 9*b* correspond to plan views of the connecting structure 3, FIG. 10 corresponds to a sectional view taken along the line E—E in FIG. 9*a*, and FIG. 11 corresponds to a sectional view taken along the line F—F in FIG. 9*a*.

FIG. 7 is a sectional view showing an inserting condition of the male mold 1 into the female mold 2 in a plane along the section taken along the line B—B in FIG. 1, and the center portion 32 of the projecting portion 3*b* is formed by the projecting surface 12 of the male mold 1, and the slant surface portions 33 are formed by the slant surfaces 13*a* of the male mold 1.

Figure 9B:
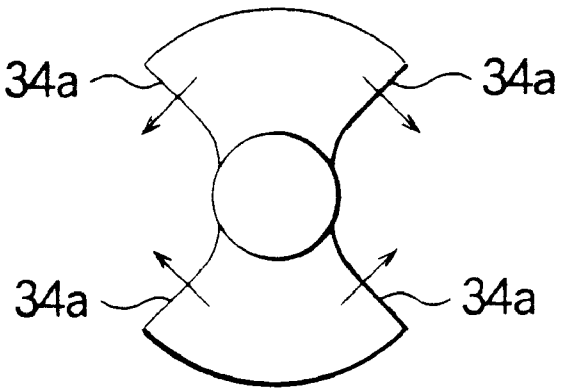
FIGS. 9*a* and 9*b* are plan views showing a connecting structure in the mode for carrying out the invention, in which 9(*a*) is useful to explain each element or the connecting structure, and 9(*b*) is useful to explain the operation of the portions of the cutting lines forming the slant surfaces.
Figure 9A:
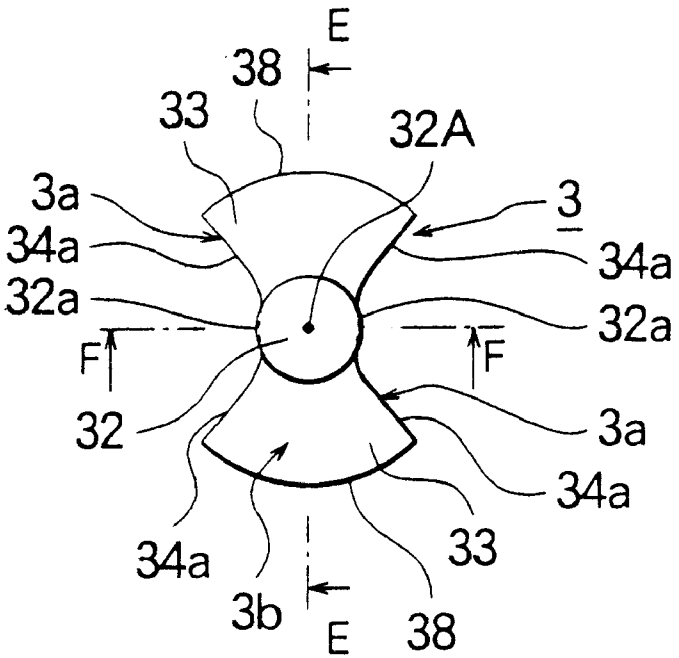
Figure 10:
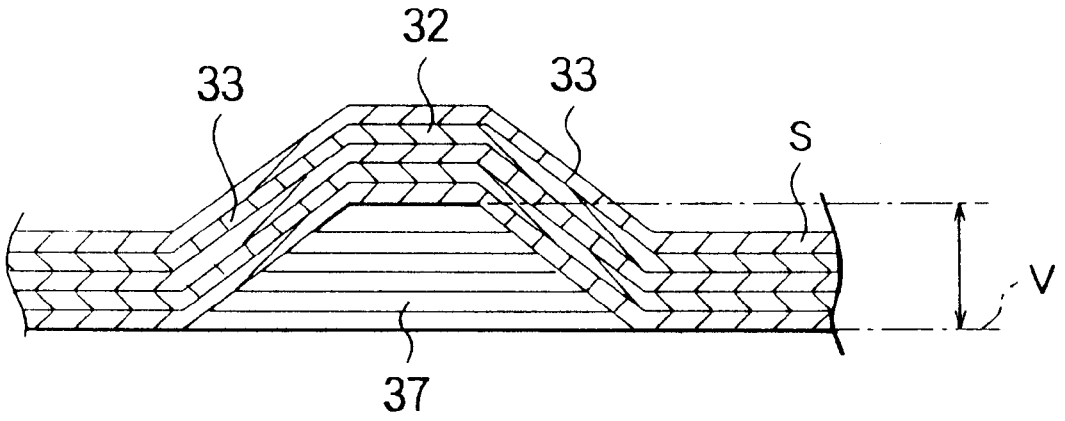
FIG. 10 is a sectional view taken along the line E—E in FIG. 9(*a*).
Figure 11:
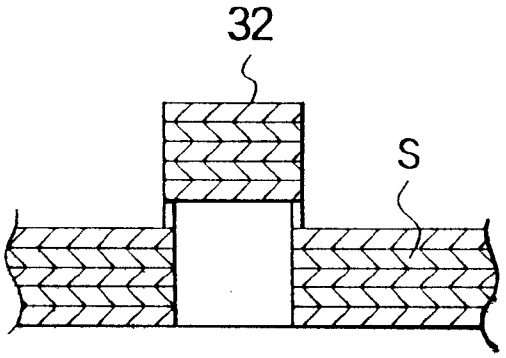
FIG. 11 is a sectional view taken along the line F—F in FIG. 9(*b*).

Furthermore, as shown in FIG. 9*a*, since the slant surface forming portions 34*a* of individual cutting lines 3*a*, which form each slant surface portion 33, extend radially with an interval of 90 degrees therebetween from the center point 32A of the center portion 32 in the plan view, at each end of the cutting line 3*a* of the laminated metal plates, the end face 37 (shown in FIG. 10) of the laminated metal plates from which the projecting portion 3*b* is cut out, abuts against the end face of the slanted portion 33, and thus, the displacement among the metal plates can be prevented in every direction in the plate plane of the laminated metal plates S. In other words, as shown in FIG. 9(*b*), since each slant surface forming portion 34*a* resists against the displacement in the direction shown by the arrow, the displacement in all the four directions can be prevented.

FIGS. 8*a*, 8*b* respectively are sectional views showing a condition just before the insertion and an inserted condition of the male mold 1 into the female mold 2 in a plane along the section taken along the line A—A in FIG. 1, and FIG. 8(*a*) shows the condition just before the insertion and (b) shows the inserted condition.

As shown in these figures, since an interval (dimension a) between the cutting lines P1, P1 in the projecting surface portion 12 of the engagement convex portion 10 of the male mold 1 is smaller than an interval (dimension A) between the cutting lines P2, P2 of the engagement concave portion 20 of the female mold 2, due to the advance of the engagement convex portion 10, opposite ends of the center portion 32 or the projecting portion are extended in the laminating direction and cut by tension within a gap M caused by a dimension difference (A−a) between the cutting lines P1, P2 of the male mold 1 and the female mold 2. As a result, the cut end portions 32*a* of the center portion 32 have a section having nicks and scratches which causes a large resistance in the displacement direction. In addition, after the engagement surface 11 of the male mold 1 reaches an upper surface S1 of the laminated metal plates S, the laminated metal plates S are pressed between an upper surface of the convex portion 25 of the female mold 2 and the engagement surface 11 of the male mold 1. As a result, the cut end portion 36 of the laminated metal plates S from which the center portion 32 has been cut out is pressed and expanded within the gap M, and thus, a sufficient overlap portion between the cut end portion 32*a* and the cut end portion 36 is obtained so that the displacement in the laminating direction is surely prevented.

Figure 12:
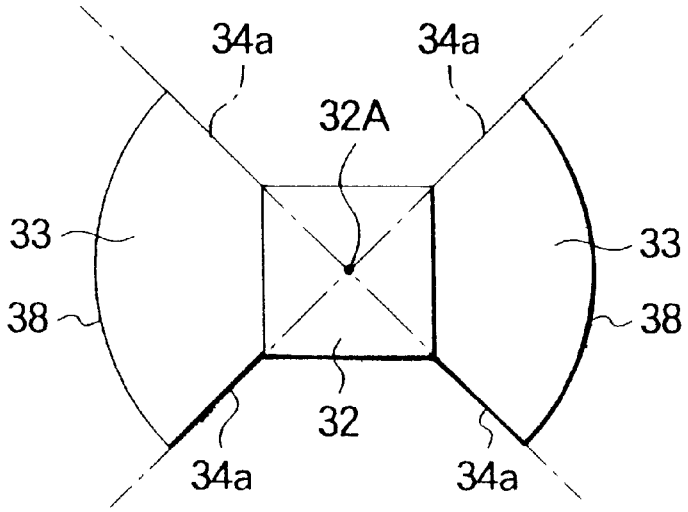
FIG. 12 is a plan view showing a connecting structure different from the mode for carrying out the invention.
Figure 13:
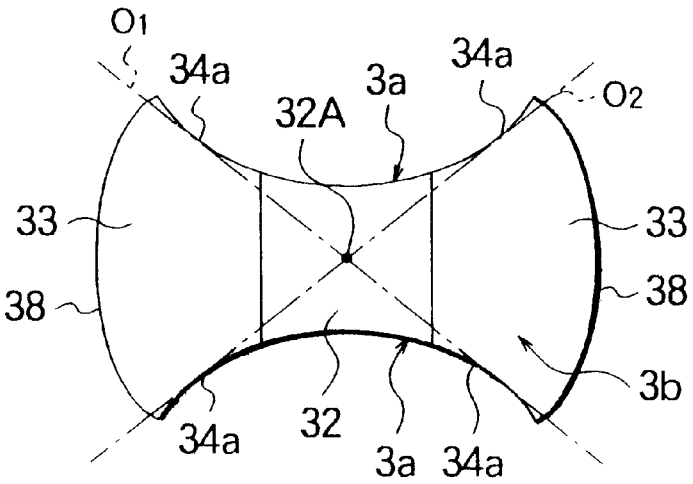
FIG. 13 is a plan view showing a connecting structure different from the mode for carrying out the invention.
Figure 14:
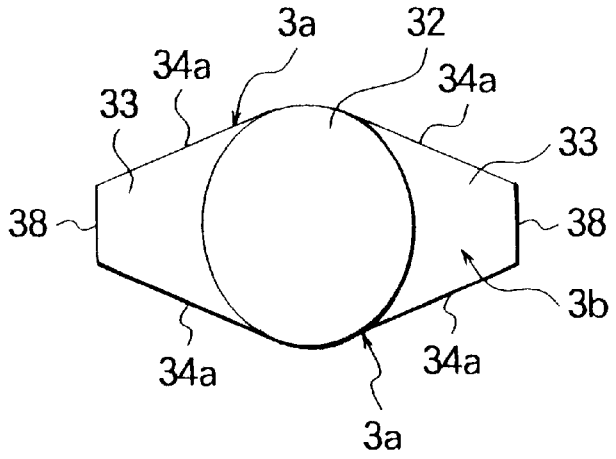
FIG. 14 is a plan view showing a connecting structure different from the mode for carrying out the invention.

In the method for carrying out the invention, there is formed with the connecting structure 3 (from FIG. 9*a*) including the circular center portion 32 and the pair of slant surface portions 33 slanted from the circular center portion with their skirt portions outwardly tapered, however, a plan shape of the connecting structure 3 may be as shown in FIGS. 12 to 14.

In a connecting structure shown in FIG. 12, a center portion 32 is made in a square shape, and slant surface portions 33 are slanted from opposing two sides of the center portion with their skirt portions outwardly tapered, and slant surface forming portions 34*a* of the cutting lines 3*a* are extended radially from a center point 32A of the center portion 32.

In a connecting structure shown in FIG. 13, each cutting line 3*a* is made to be a circular arc shape which is continuous by a center portion 32 and slant surface portions 33. This circular arc has tangents 01 and 02 which extend radially from a center point 32A of the center portion 32.

In a connecting structure shown in FIG. 14, a pair of slant surface portions 33 of a projecting portion 3*b* has a shape in which the slant surface portions 33 are slanted from an elliptical center portion 32 towards a laminated metal surface with their skirt portions 33 inwardly tapered, and slant surface forming portions 34*a* of each cutting line 3*a* are radial in the plane of the laminated metal plates. In this structure, similar to the mode for carrying out in FIGS. 9*a*, 9*b* and the cases in FIGS. 12 and 13, the displacement of the metal plates in every direction in the plane of the laminated metal plates is prevented. However, since the slant surface forming portions 34*a* are formed to be inwardly tapered from the center portion 32, in the case of the same length of the cutting lines 3*a*, the width of rising portions 38 of the slant surface portions 33 become narrow, and the strength at the rising portions 38 of the projecting portion 3*b* becomes small. In contrast, as shown in FIGS. 9*a*, 9*b*, 12 and 13, it is preferable that the slant surface forming portions 34*a* of each cutting line 3*a* have the shape of outwardly tapering toward the outer side from the center portion 32, since the strength at the rising portions 38 of the projecting portion 3*b* is higher.

Furthermore, the slant surface forming portions 34*a* of each cutting line 3*a*, as shown in FIGS. 9*a*, 9*b*, 12 and 13, are not necessarily required to align with the lines which expand radially from the center point 32A of the center portion 32. If the slant surface forming portions 34*a* are formed so that the lines adjacent to each other in a circumferential direction are directed to two different directions in the plane of the laminated metal plates, the effect will be achieved to prevent the displacement among the metal plates in every direction in the plane of the laminated metal plates S.

Figure 15:
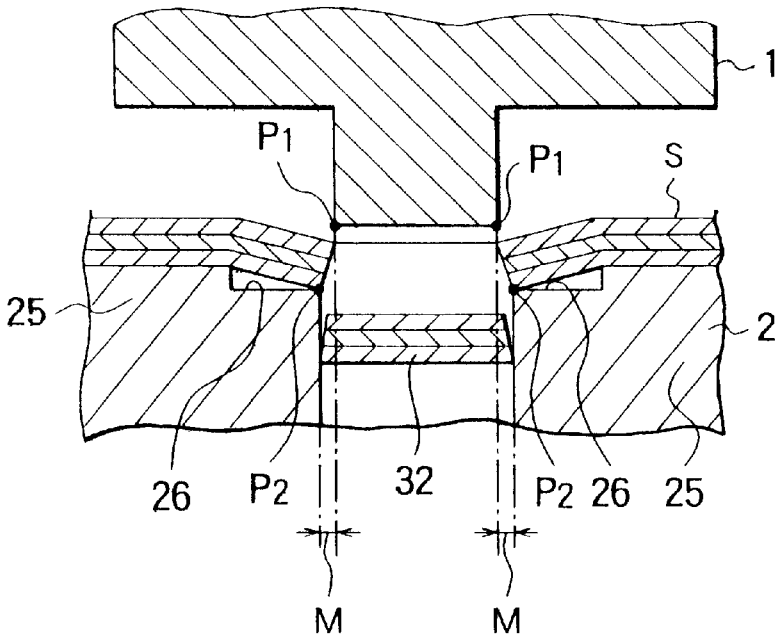
FIG. 15 is a schematic sectional view showing another mode for carrying out the connecting method of laminated metal plates according to the invention.

Furthermore, in the above-mentioned press mold, although the pressing convex portions 25 are formed on the engagement surface 21 of the female mold 2, this pressing convex portions 25 may be formed on corresponding positions on the engagement surface 11 of the male mold 1, or may be formed on both the male mold 1 and female mold 2. Furthermore, the pressing convex portions 25 are not required to be necessarily formed on the positions which coincide with both cutting lines P2, P2 of the engagement concave portion 20 of the female mold 2, but as shown in FIG. 15, the pressing convex portions 25 may be formed outside both the cutting lines P2, P2 by providing concave portions 26 at positions which coincide with both the cutting lines P2, P2. By virtue of this, the laminated metal plates S, after being cut by tension in the laminating direction by the gap M mentioned above, are extended laterally in the concave portions 26 to a larger extent than in the case of FIG. 8, and thus, it is possible to make the metal plates more difficult to displacement in the laminating direction.

Figure 16:
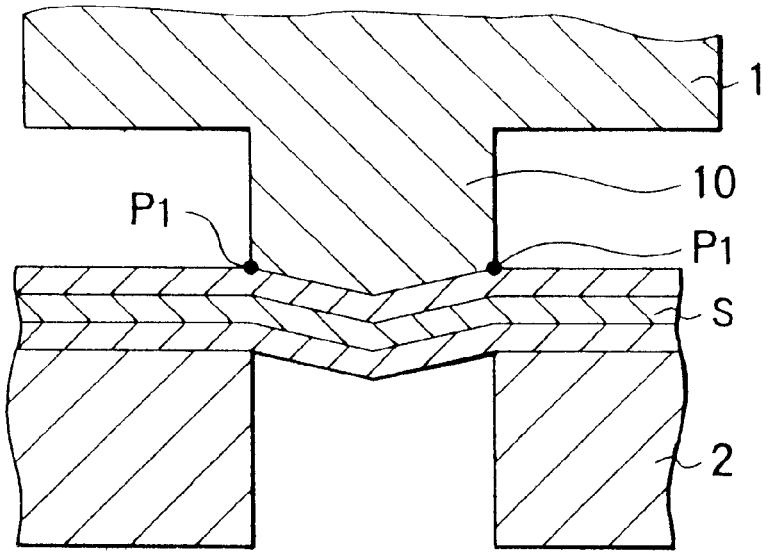
FIG. 16 is a schematic sectional view showing one mode for carrying out the connecting method of laminated metal plates according to the invention.
Figure 17:
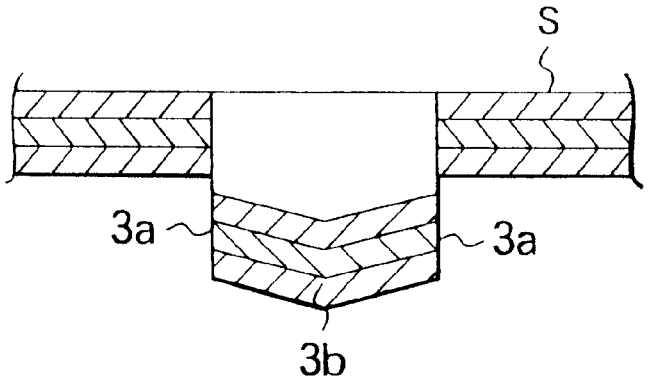
FIG. 17 is a sectional view showing a sectional shape or the projecting portion between the cutting lines formed by the method shown in FIG. 16.

Furthermore, as shown in FIG. 16, when a section of a projecting surface portion of the male mold 1 between cutting lines P1, P1 is made to have a shape protruding more at the center side than both the cutting line P1 sides, and as shown in FIG. 17, when the projecting portion 3*b* is pressed and deformed so that, in the section of the projecting portion 3*b* along the line F—F in FIG. 9*a*, both the cutting line 3*a* sides approach more to the surfaces of the metal plates S than the center side of the projecting portion 3*b*, the projecting portion 3*b* is deformed to outwardly taper to the width of the dimension between the two cutting lines 3*a* and against the displacement the metal plates in the laminated direction. That is, when the metal plates intend to move away in the displacement direction, the end portions of the cutting line 3*a* sides or the projecting portion 3*b* are caught by the end portions or the metal plate sides, so that the larger the force exerted in the displacement direction, the more becomes the deformation in the direction to expand the width of the projecting portion 3*b*. As a result, since the cut end of the projecting portion 3*b* is overlapped with the cut end portion or the metal plates in the laminating direction, the displacement or the metal plates in the laminating direction is surely prevented.

Figure 18:
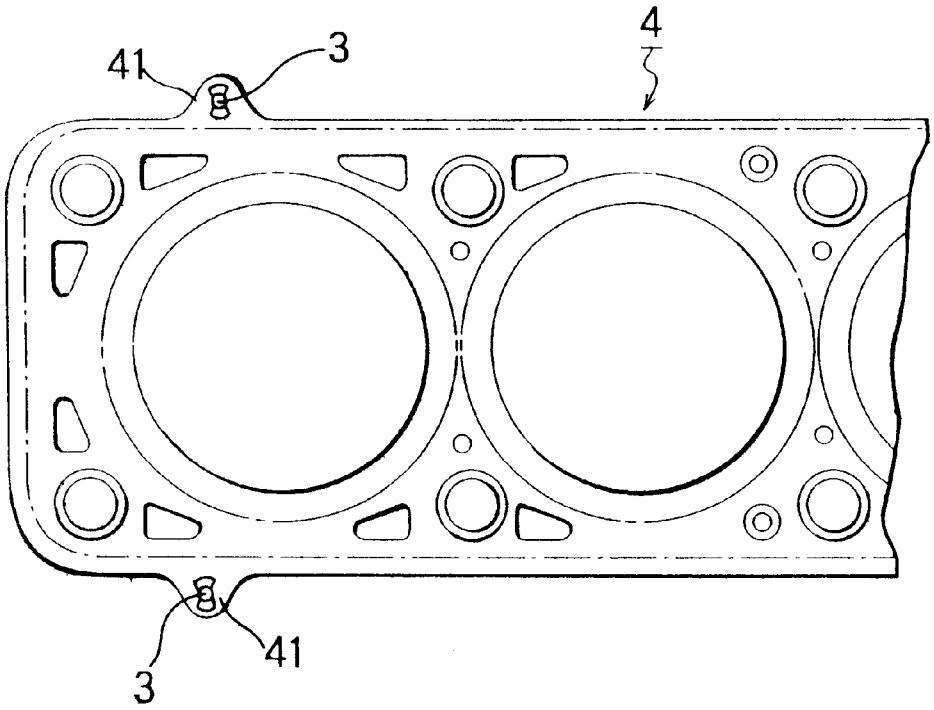
FIG. 18 is a plan view showing an example in which the mode for carrying out the method is applied to a metal gasket.
Figure 19:
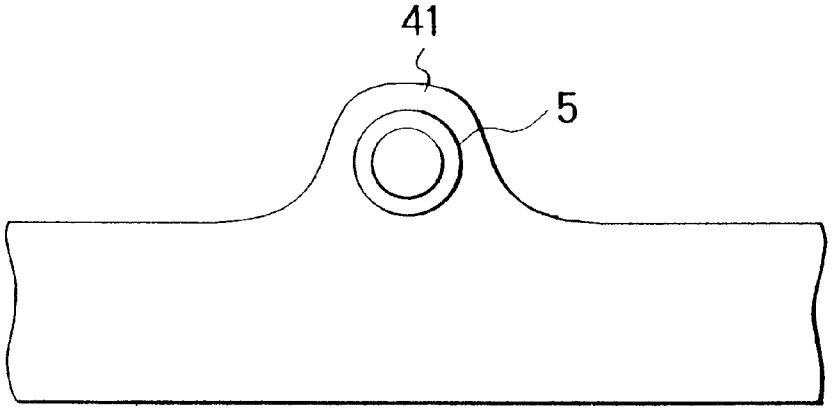
FIG. 19 PRIOR ART
FIG. 19 is a plan view showing a conventional example of connecting method of a metal gasket.
Figure 20:
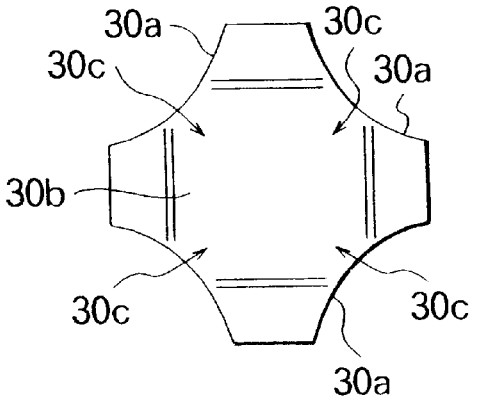
FIG. 20 PRIOR ART
FIG. 20 is a plan view showing another conventional example of connecting method of a metal gasket.
Figure 21:
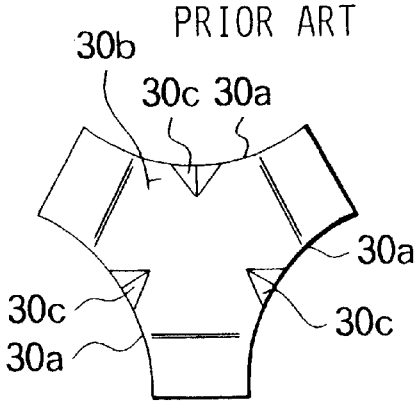
FIG. 21 PRIOR ART
FIG. 21 is a plan view showing another conventional example of connecting method of a metal gasket.
Figure 22:
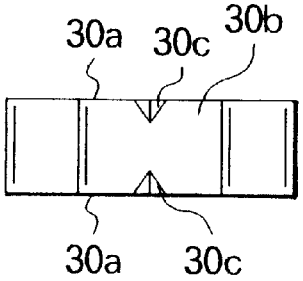
FIG. 22 PRIOR ART
FIG. 22 is a plan view showing another conventional example of connecting method of a metal gasket.

FIG. 18 is a plan view showing an example of connecting a metal gasket or a laminated structure by the method in the above-mentioned mode for carrying out the invention. In this example, similar to the connection by the conventional eyelet hole, the connection structure 3 in the above-mentioned mode for carrying out the invention is formed in a connecting portion 41 of a tongue shape which is formed at an outer peripheral edge. However, since this connection structure 3 protrudes to only one surface side different from the conventional eyelet hole, such a connecting portion 41 is not necessarily required to be formed at the outer peripheral edge, and thus, the shape of the outer peripheral edge of the metal gasket can be made simple.

Specifically, in the case where there is no need to communicate water holes or a cylinder head and a cylinder block with each other by the metal gasket, and since the water hole is not opened in the cylinder head, the connecting structure 3 as mentioned above can be formed at that position. Furthermore, even when a cast escaping hole for the purpose or reducing weight is formed in a joint surface or the cylinder head or cylinder block with the metal gasket, and since there is no need to provide a hole in the metal gasket corresponding thereto, the connecting structure 3 as mentioned above may be disposed at that position, and the projecting portion 3*b* may be protruded towards the cast escaping hole.

What is claimed is:

1. A method for connecting laminated metal plates with each other, said metal plates having an essentially planar surface and a predetermined thickness, the method comprising the steps of:

forming two cutting lines independent of each other in the laminated metal plates, and cutting the laminated metal plates to form first cut end faces and second cut end faces of the planar surface of the laminated metal plates along said cutting lines with a male mold die and a female mold die, said male mold die having a step larger in height than the thickness of the laminated metal plates;

pressing the male mold die in a laminated direction toward the female mold die so as to form a projecting portion of the laminated metal plates with the first cut end faces between said two cutting lines in the laminated metal plates such that the first cut end faces of said projecting portion engage with the second cut end faces of the planar surface of the laminated metal plates; the step of pressing the male mold die then providing for forming the projecting portion to have a center portion protruding to a highest position from the planar surface of the metal plates, and forming the projecting portion to have a pair of slant surface portions slanted from the center portion towards said planar surface of the metal plates, and forming the projecting portion to have four slant forming portions which are a part of said cutting lines and define said pair of slant surface portions, wherein the slant surface portions are respectively aligned with lines which outwardly extend radially from said center portion so as to form an outwardly tapered skirt portion of said slant surface portions.

2. A method for connecting laminated metal plates claimed in claim 1, wherein said four slant forming portions taper outwardly from said center portion of said projecting portion and are positioned adjacent to and 90° relative to each other around said center portion.

3. A method for connecting laminated metal plates with each other, said metal plates having an essentially planar surface and a predetermined thickness, the method comprising the steps of:

forming two cutting lines independent of each other in the laminated metal plates, and cutting the laminated metal plates to form first cut end faces and second cut end faces of the planar surface of the laminated metal plates along said cutting lines with a male mold die and a female mold die, said male mold die having a step larger in height than the thickness of the laminated metal plates;

pressing the male mold die in a laminated direction toward the female mold die so as to form a projecting portion of the laminated metal plates with the first cut end faces between said two cutting lines in the laminated metal plates such that the first cut end faces of said projecting portion engage with the second cut end faces of the planar surface of the laminated metal plates; the step of pressing the male mold die then providing for forming the projecting portion to have a center portion protruding to a highest position from the planar surface of the metal plates, and forming the projecting portion to have a pair of slant surface portions slanted from the center portion towards said planar surface of the metal plates, and forming the projecting portion to have four slant forming portions which are a part of said cutting lines and define said pair of slant surface portions, wherein the slant surface portions are respectively aligned with lines which outwardly extend radially from said center portion so as to form a skirt portion of said slant surface portions;

after forming said projecting portion, then pressing the second cut end faces of said laminated metal plates so as to expand the laminated metal plates in the laminating direction into engagement with each other by overlapping the first cut end faces and the second cut end faces along said two cutting lines in the laminating direction.

4. A method for connecting laminated metal plates claimed in claim 3, wherein said four slant forming portions tapers outwardly from said center portion of said projecting portion, and each slant forming portion is positioned adjacent to and 90° relative to another slant forming portion.

5. A method for connecting laminated metal plates with each other, the metal plates having essentially planar surface and a predetermined thickness, the method comprising the steps of:

forming two cutting lines independent of each other in the laminated metal plates for forming cut end portions in the laminated metal plates; forming a projecting portion with a center portion between said two cutting lines with a height above the planar surface of the metal plates, said height being larger than the thickness of the laminated metal plates; pressing the metal plates in order to expand the cut end portions of said laminated metal plates; and forming a pair of slant surfaces slanting from said center portion toward the planar surface of the metal plates, wherein the step of forming said cutting lines includes the steps of forming a total of four slant forming portions which are a part of said cutting lines and define said pair of slant surfaces, said slant forming portions respectively aligned with lines which outwardly extend radially from said center portion so as to form a skirt portion of said slant surface portions.

6. A method for connecting laminated metal plates claimed in claim 5, wherein said four slant forming portions taper outwardly from said center portion of said projecting portion and each slant forming portion is positioned adjacent to and 90° relative to another slant forming portion.

7. A method for connecting laminated metal plates with each other, the laminated metal plates having a predetermined thickness, said method comprising the steps of:

using a press mold with a male mold and a female mold each having planar surfaces, and the planar surface of the male mold having an engagement convex portion formed thereon for engaging with the female mold, said convex portion consisting of a center projecting surface protruding by a dimension larger than the thickness of the laminated metal plates and having a pair of slant surfaces slanting toward said planar surface of said male mold for engaging with said female mold, said male mold having two edge lines for cutting comprising contour lines of lateral sides of said slant surfaces and surface lines of said center projecting surface connecting said contour lines, said female mold having two mating edge lines, said male mold and female mold configured so that the distance between said edge lines of the male mold are smaller by a predetermined dimension than the distance between the two mating edge lines of said female mold, a pressing protrusion formed at a position including one of along with both edge lines and outside of both edge lines on said surface of at least one of said male and female molds, said slant surfaces slanting from said center projecting surface toward said planar surface of one of the male and female molds with outwardly tapering skirt portions;

connecting the laminated metal plates by disposing the laminated metal plates having a planar surface between said male mold and female mold and pressing said both molds onto the laminated metal plates such that said two cutting lines independent of each other on said laminated metal plates are cut to form cut lines, and the portion between the cut lines of the laminated metal plates is protruded from the laminated direction of the laminated metal plates by a step height larger than the thickness of the laminated metal plates so as to form a projecting portion of the metal plates having cut end portions and an unprojecting portion having other cut end portions in order to engage the cut end portions of the projecting portion of the laminated metal plates with the other cut end portions of the unprojecting portion of the laminated metal plates, said projecting portion of the laminated metal plates consisting of a center portion protruded at a height highest from the planar surface of the laminated metal plates and a pair of slant surfaces slanting from said center portion toward the unprojecting portion of said laminated metal plates, said pair of slant surfaces including four slant forming portions;

wherein the four slant forming portions which are a part of said cut lines and define said pair of slant surfaces are respectively aligned with lines which extend radially from said center portion so as to form a skirt portion of said slant surfaces.

8. A method for connecting laminated metal plates claimed in claim 7, further including the steps of extending a total of four lateral outer lines from said center portion of said projecting portion by an angle 90° relative to each other, said four lateral outer lines defining said pair of slant surfaces of said male molds, and also outwardly tapering said slant surfaces of said projecting portion wherein each slant forming portion is positioned adjacent to and 90° relative to another slant forming portion.

* * * * *